US005775056A

United States Patent [19]

Rauhala et al.

[11] Patent Number: 5,775,056

[45] Date of Patent: Jul. 7, 1998

[54] METHOD AND APPARATUS FOR WRAPPING A PACKAGE AND FORMING FOLDS OF THE WRAPPING SHEET ONTO THE TOP SURFACE OF THE PACKAGE

[75] Inventors: Juhani Rauhala, Jurva; Heikki Airola, Sahalahti, both of Finland

[73] Assignee: Vesme Systems Oy, Finland

[21] Appl. No.: 649,621

[22] PCT Filed: Nov. 25, 1994

[86] PCT No.: PCT/FI94/00528

§ 371 Date: May 22, 1996

§ 102(e) Date: May 22, 1996

[87] PCT Pub. No.: WO95/14614

PCT Pub. Date: Jun. 1, 1995

[30] Foreign Application Priority Data

Nov. 29, 1993 [FI] Finland ..... 935291

[51] Int. Cl.[6] ..... B65B 11/04

[52] U.S. Cl. ..... 53/397; 53/449; 53/587; 53/211; 53/372.7

[58] Field of Search ..... 53/399, 449, 491, 53/587, 176, 211, 397, 212, 376.4, 376.5, 377.3, 377.4, 371.8, 372.2, 372.6, 372.7, 370.3, 556, 588

[56] References Cited

U.S. PATENT DOCUMENTS

| | | | |
|---|---|---|---|
| 209,985 | 11/1878 | Rettig | 53/372.6 |
| 1,351,809 | 9/1920 | Sutherland | 53/372.6 |
| 2,196,666 | 4/1940 | Moore | 53/372.2 |
| 3,035,938 | 5/1962 | Schwinger | 53/370.3 |
| 3,660,958 | 5/1972 | Garrison | 53/399 |
| 3,763,629 | 10/1973 | Carlstrom et al. | 53/372.2 |
| 3,924,375 | 12/1975 | Brenner et al. | 53/370.3 |
| 4,362,001 | 12/1982 | Cockerham, Jr. et al. | 53/556 |
| 4,450,668 | 5/1984 | Grossi | 53/587 |
| 4,821,489 | 4/1989 | Macleod et al. | 53/399 |
| 5,005,335 | 4/1991 | Yourgalite et al. | 53/399 |
| 5,131,209 | 7/1992 | Schreiber et al. | 53/556 |

*Primary Examiner*—Linda Johnson
*Assistant Examiner*—John Paradiso
*Attorney, Agent, or Firm*—Larson & Taylor

[57] ABSTRACT

A method of wrapping an object with a substantially inelastic wrapper, such as paper, while keeping the object in rotation about its upright axis. The wrapping material is wider than the height of the object. Wrapping is initiated by locking a portion of the wrapper material against the top end of the object. As the object is rotated, the wrapping material is pressed around the vertical sides of the object. After the object sides are wrapped, the remaining portion of the web material which extends above the top end of the object is pressed downwardly against the top end of the object.

20 Claims, 4 Drawing Sheets

METHOD AND APPARATUS FOR WRAPPING A PACKAGE AND FORMING FOLDS OF THE WRAPPING SHEET ONTO THE TOP SURFACE OF THE PACKAGE

The invention relates to a wrapping method and necessary apparatus for utilization of the method in accordance with the introduction in patent claim 1.

Previously is known a wrapping system by the EP publication No. 0 180 517, where wrapping is made with plastic film in rolls. Wrapping of a package is started from its top surface, whereby the system has devices by means of which the front end of the sheet is pressed onto the package and kept there. For wrapping the package, the sheeting has to be guided by special drivers down from the top surface and wound into a wrap-around pack sheeting.

In the U.S. Pat. No. 3,507 089 a wrapping apparatus is published that carries out wrapping without rotating the object and with wrapping material broader than the package. Also the foldings of wrapper ends are made by the apparatus.

Neither of the above presented solutions applicable in cases where paper is used as wrapper. In using paper it is not possible to make a turn without tearing the paper, when must be folded from the package top surface in order to make a wrap-around cover. Anyhow, paper is not suitable for use in web form as package protecting wrapper. A solution according to the U.S. patent is not suitable for wrapping a package on a pallet.

With the wrapping method and wrapping apparatus according to this invention a decisive improvement of the above presented wrapping methods is achieved and the invention is characterized in what is presented in the enclosed patent claims.

The most important advantages of the invention can be considered the applicability of recycling wrapper, such as paper, to mechanical wrapping of packages, when the different stages of wrapping have been rearranged. Wrapping can be started without gumming the wrapper to the goods and the invention comprises the apparatus by means of which the wrapper is wound around the package with certain, appropriate tension. The number of wrap-arounds will amount only to a fraction of what is the case by using film sheeting, which means increased packing speed and one also gets rid of the heating phase. Protection of package top side is easily done with paper or similar materials, because they can be gummed, which is a problem with plastic wrappers, by the use of which the package top must be protected by some other means.

In the following the invention is described in detail with reference to the enclosed drawing, where FIG. 1 is the start of the wrapping procedure.

Figure 1:
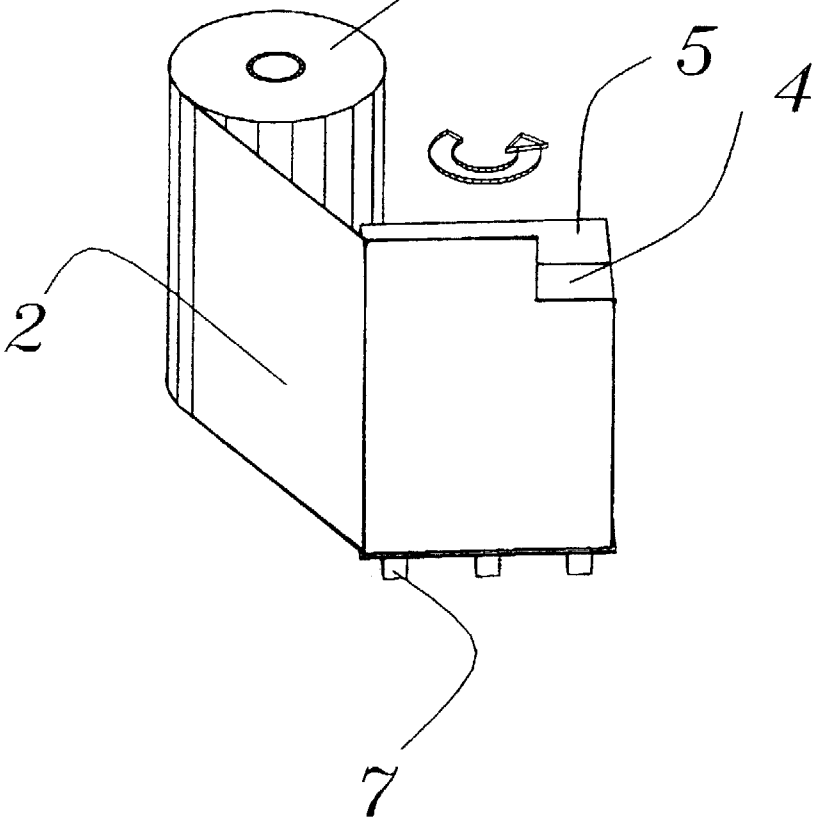

FIG. 1 shows a wrapper roll 1 in upright position, a rectangular package 5 on a pallet 7 and wrapper 2 being fed out from roll 1. Wrapper 2 is broader than the height of package 5. Wrapping is started by folding the paper upper edge 4 onto package 5. In the upper edge an incision is made, whereat fold 4 can be made separately. Fold 4 is pressed against package 5 by some known means, for instance a press descending to the top, whereby wrapping around the package can be started by rotating the pallet 7. From the start, wrapper 2 is in proper position with regard to the package and, with a rectangular package, even inelastic wrapper settles properly around the package. Rotation is continued in order to produce sufficient wrapper overlapping. The incision is not necessary, the upper edge can be also folded onto the package without an incision, whereby, however, some creasing cannot be avoided.

Figure 2:
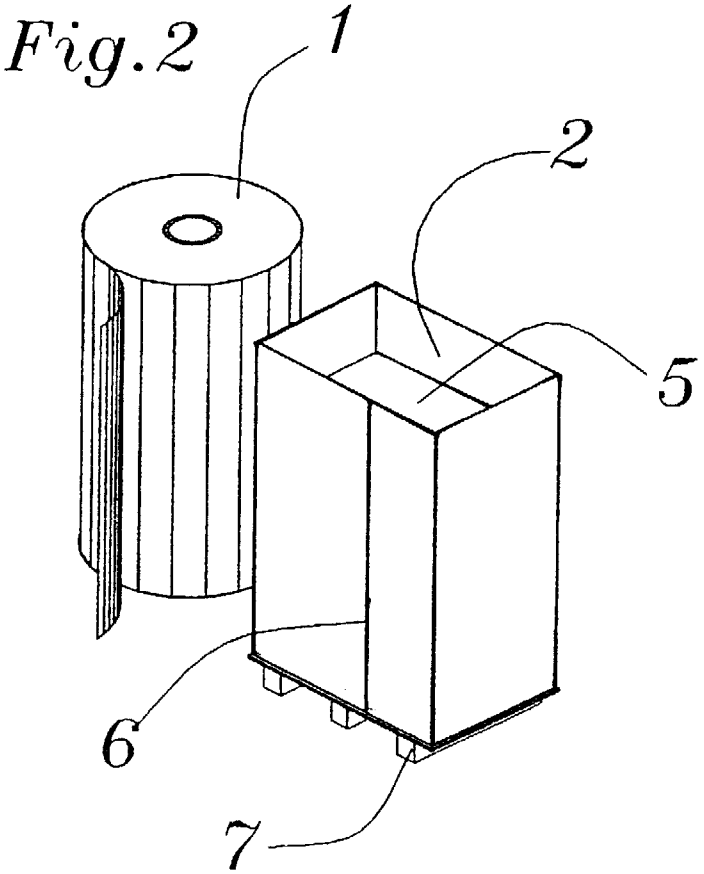
FIG. 2 is the wrapping around a package on pallet.
Figure 3:
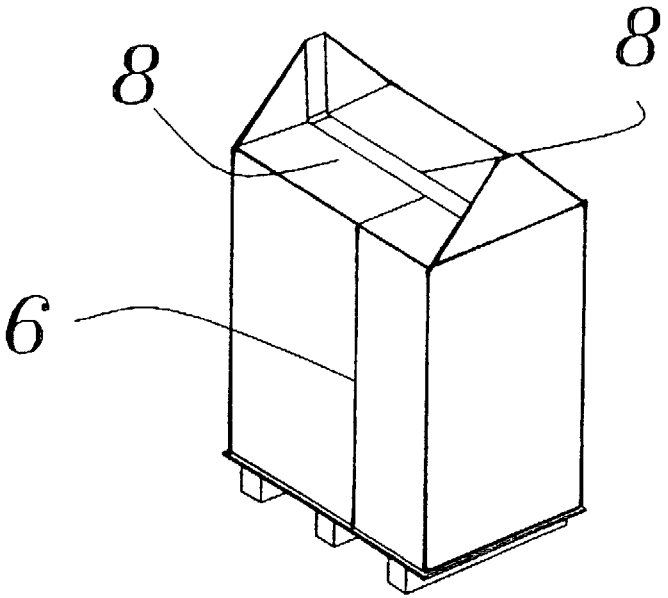
FIG. 3 is the wrapping folded onto package.

In FIG. 2 the wrapper is cut of f and on the wrapper inside, close to the cut edge, glue has been sprayed, seam 6 sealed and the package wrapped. FIG. 3 shows the upper edges 8 of wrapper folded onto package 5 and in FIG. 4 the upper edges 9 are also folded onto the package. Glue can be used to fix the folds. Finally, with glue it is easy to fix, for instance, a separate paper cover or similar on the package.

FIGS. 1–4 show the embodiment of the wrapping procedure with inelastic wrapper and using one wrapper roll 1, but the actual wrapping apparatus is not shown in the figures.

Figure 5:
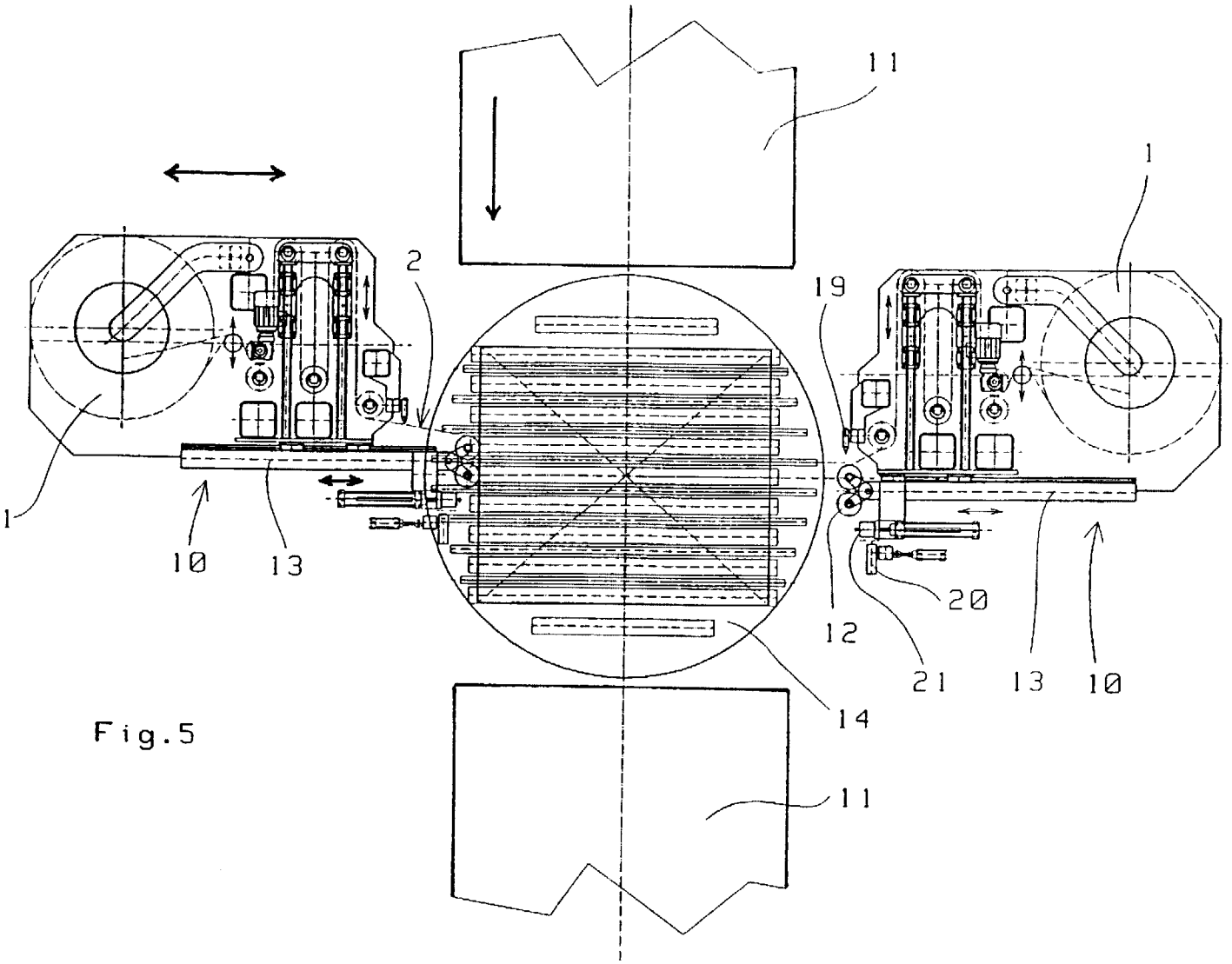
FIG. 5 is the wrapping station viewed from above.

FIG. 5 shows a wrapping station viewed from above, where there are two wrapping machines 10, a revolving platform 14 and conveying rails 11, along which package 5 is conveyed on its own pallet to and from the station. The revolving platform 14 is also furnished with rollers for package conveyance.

The wrapping machines 10 have suspenders for wrapper roll 1, a rail along which wrapper 2 is conveyed to the target, wrapper 2 cut-off apparatus 20, glue spraying apparatus 19 and adjusters to control the tension of wrapper, while moving on the rail. The wrapping machines, themselves, can also be shifted sideways according to the package size. On special guides 13, there are press roller systems 12 comprised of two parallel upright rollers, which are made rotatable by bearings and the body of the rollers is articulated to revolve also about its upright axle. With the rollers the wrapper 2 is pressed against the rotating package. The rollers on guides 13 are reversing and pushed forward due to the changing reach range of package outer surface. One tries to keep the pressing force constant. By means of two parallel rollers the pressing function is made more stable when the rollers are passing a package corner. Naturally, there can also be a single roller only and in the roller or one of the rollers a certain braking effect can be adjusted, by means of which it is possible to affect the wrapper tension. The wrapper cutoff apparatus 20 is most advantageously a vertically movable rotating blade. The glue spraying apparatus 19 is most advantageously a nozzle applying hot-setting adhesive in doses. For holding the wrapper there is a suction rod 21, which by means of low pressure sticks to the paper and holds it from the end near the cut edge.

When using two wrapping machines 10, different kinds of wrappers can be wrapped simultaneously one upon another, or different kinds of wrapper can be wrapped alternately one upon another around the package.

It is advantageous to make such kind of wrapping machines which can be adjusted to handle wrappers of different widths.

Figure 6:
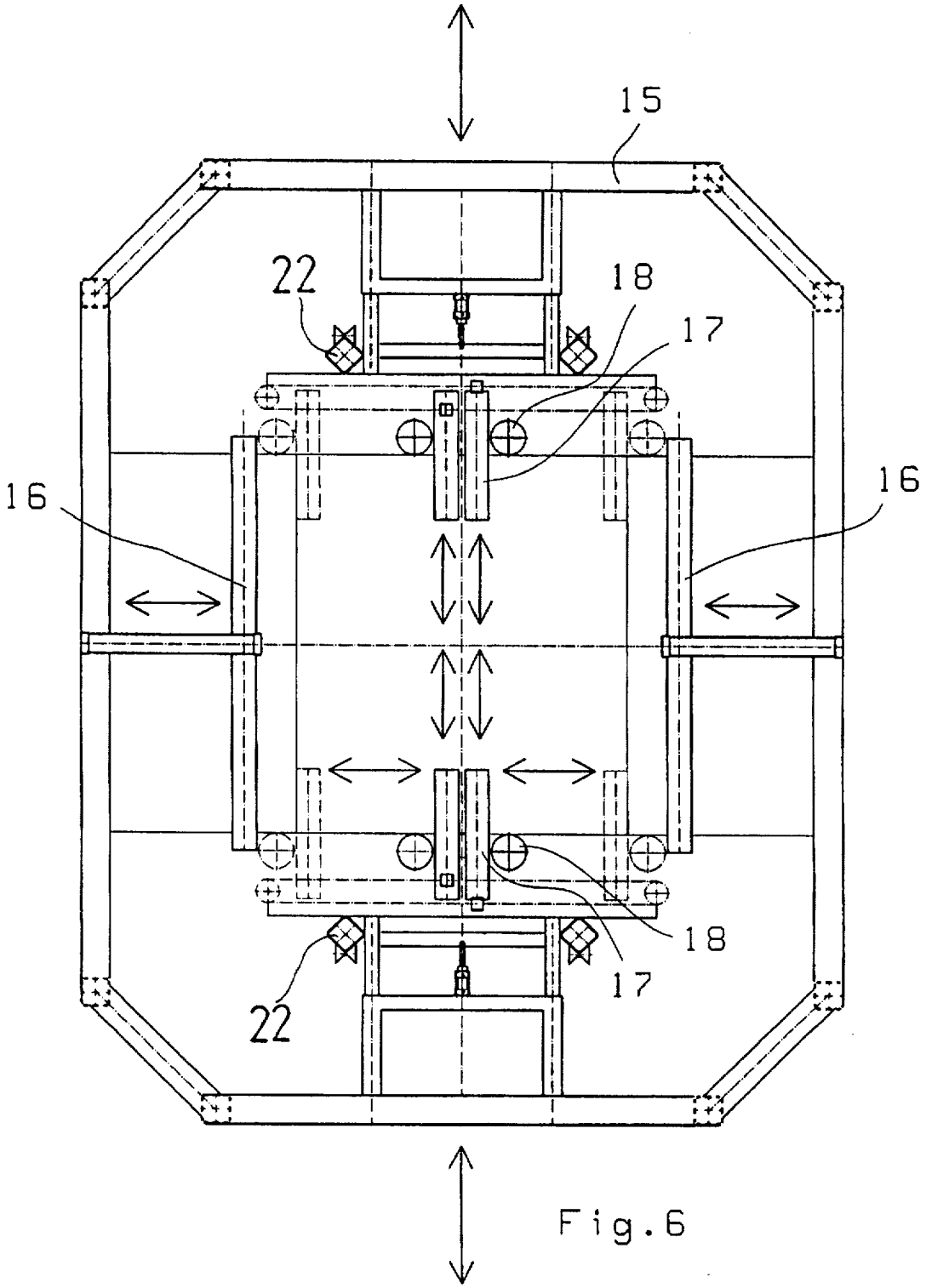
FIG. 6 is the wrapper folding apparatus viewed from above.

FIG. 6 shows a wrapper folding apparatus viewed from above, which has a frame 15 that can be positioned above the package.

To the frame 15 pressing rollers 17 are fixed face to face in pairs. In the first stage the rollers press the wrapper edges onto the package 8 as shown in FIG. 3. According to the package size, the rollers 17 are rolled a certain distance. In order to get the wrapper 2 controllably folded, there are, connected to rollers 17, upright rollers 18 that press against the package surface simultaneously. By rolling the rollers 17 and 18 the wrapper upper edge is folded accurately onto the package. The rollers are vertically adjustable with guides 22 according to the package height, and the distance of the face to face rollers pairs can also be adjusted according to the variation of the package outer dimensions.

Figure 4:
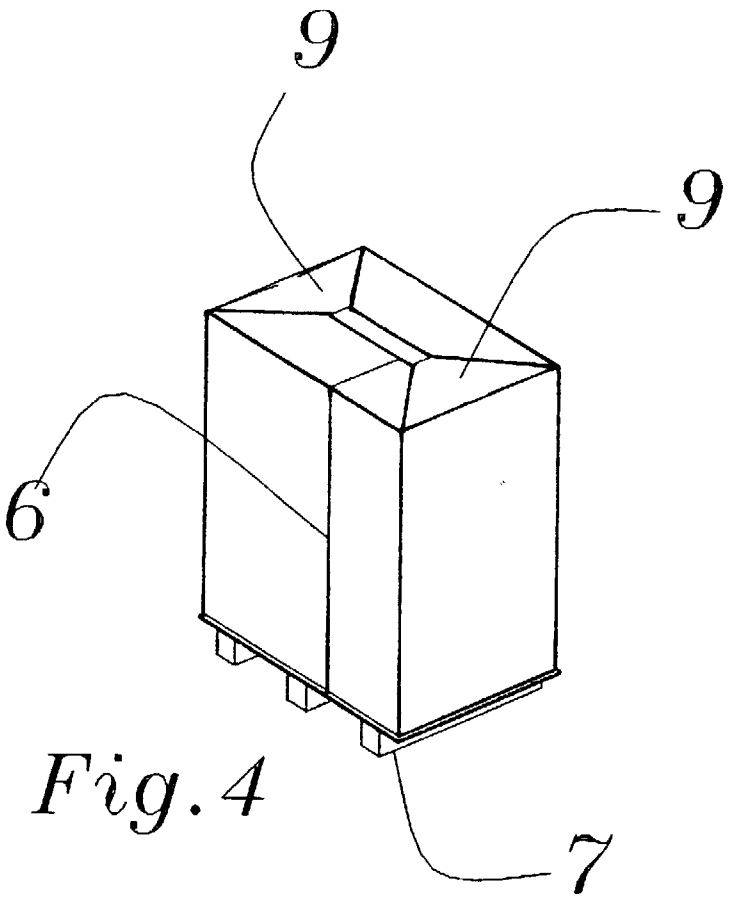
FIG. 4 is a wrapped package on pallet.

Further, there is another pair of face to face rollers 16 in the frame, which carry out the wrapper edge 9 folding according to FIG. 4. The rollers 16 are moved against each other, whereat the the wrapper edge becomes folded. A glue spraying device can be connected to the apparatus, by means of which e.g. the last folded wrapper edges can be gummed to the wrapper underneath.

Although the pressers have been illustrated in FIG. 6 as rotating rollers, they can also be flat parts, by means of which the pressing and folding of wrapper edges 8,9 is carried out. Anyhow, the invention is presented with reference to one advantageous embodiment only, while many modifications are possible within the inventional concept determined in the patent claims.

We claim:

1. A method of wrapping an object with a substantially inelastic wrapper comprising the steps of:

positioning an object to be wrapped on a rotatable pallet such that a bottom end of the object rests on the pallet and such that the object extends vertically upwardly from said pallet to a top end of the object;

providing a web of substantially inelastic wrapper material which is wider than the vertical height of the object positioned on the pallet;

feeding a leading end of said web to a vertical side of the object positioned on the pallet such that a lower edge of said web is adjacent to said bottom end of said object and such that an upper edge of said web is above said top end of said object;

folding a portion of the web material which extends between said top end of said object and the upper edge of the web, downwardly against the top end of the object;

pressing only the folded web portion against said top end of said object to hold the web against the object;

rotating the object, while the folded web portion is held against the top end of the object, to cause the vertical sides of the object to be wrapped by said web;

securing a trailing edge of said web to the wrapped object; and folding the remaining portion of the web which extends between the top end of the object and the upper edge of the web, downwardly against the top end of the object.

2. A method according to claim 1 wherein said wrapper material comprises paper.

3. A method according to claim 1 wherein said object comprises a package.

4. A method according to claim 1 further comprising pressing said web against the vertical side of said object as the object is being rotated and wrapped by said web.

5. A method according to claim 1 wherein said securing step comprising cutting the web to form said trailing end, applying an adhesive to said trailing end, and adhering the trailing end to the wrapped object.

6. A method according to claim 1 wherein the providing step comprises providing a plurality of webs of different widths, and wherein the feeding step further comprises selecting from said plurality of webs a web having a width greater than the vertical height of a positioned object.

7. A method according to claim 1 further comprising securing said folded remaining web portion to the top end of said object.

8. A method according to claim 1 wherein said providing step comprises providing a plurality of said webs, and wherein said feeding step comprises feeding said plurality of said webs simultaneously to said object whereby said plurality of webs are wrapped simultaneously one upon another around said object.

9. A method according to claim 1 wherein said providing step comprises providing a plurality of said webs, and wherein said feeding step comprises feeding said plurality of said webs alternately to said object whereby said plurality of webs are wrapped alternately one upon another around said object.

10. Apparatus for wrapping an object with a substantially inelastic wrapper comprising:

a rotatable pallet for positioning an object in a wrapping position such that a bottom end of the object rests on the pallet and such that the object extends vertically upwardly from the pallet;

supply means for supplying a web of substantially inelastic wrapper material which is wider than the vertical height of an object positioned in said wrapping position on said pallet;

means for feeding a leading end of said web from said supply means to a vertical side of an object positioned in said wrapping position such that a lower edge of said web is adjacent a bottom end of said object and such that an upper edge of said web is above a top end of said object;

means for folding a portion of the web material which extends between a top end of the object and an upper edge of the web, downwardly against a top end of the object;

means for pressing only the folded web portion against a top end of an object to hold the web against an object;

means for rotating the object, while the folded web portion is held against the top end of the object, to cause vertical sides of the object to be wrapped by the web;

means for securing a trailing end of the web to the wrapped object; and means for folding the remaining portion of the web which extends between the top end of the object and the upper edge of the web, downwardly against the top end of the object.

11. Apparatus according to claim 10 further comprising means for pressing said web against a vertical side of said object as the object is being rotated and wrapped by said web.

12. Apparatus according to claim 10 wherein said securing means comprises means for cutting the web to form said trailing end, means for applying an adhesive to said trailing end, and means for adhering the trailing end to a wrapped object.

13. Apparatus according to claim 10 wherein said supply means comprises means for supplying a plurality of webs of different widths, and wherein said feeding means comprises means for selecting from said plurality of webs a web having a width greater than the vertical height of a positioned object.

14. Apparatus according to claim 10 further comprising means for securing said folded remaining web portion to the top end of an object.

15. Apparatus according to claim 10 wherein said supply means comprises means for supplying a plurality of said webs, and wherein said feeding means comprises means for feeding said plurality of webs simultaneously to an object for simultaneously wrapping said plurality of webs one upon another around said object.

16. Apparatus according to claim 10 wherein said supply means comprises means for supplying a plurality of webs and wherein said feeding means comprises means for feeding said plurality of webs alternately to said object for alternately wrapping said plurality of webs one upon another around said object.

17. Apparatus according to claim 11 wherein said pressing means comprises a pair of rollers mounted on an articulated body such that the roller axes are oriented vertically, said articulated body being mounted for movement towards and away from said object to permit the rollers to remain pressed against the sides of the object as the object is being rotated.

18. Apparatus according to claim 10 wherein said means for folding the remaining portion of said web against the top end of the object comprises a frame having two pairs of face to face pressers, the mutual distance between faces of each pair being adjustable.

19. Wrapping apparatus according to claim 17 wherein said pressers comprise rotating rollers.

20. Wrapping apparatus according to claim 17 wherein said pressers comprise flat sheets.

* * * * *